US011585505B2

(12) United States Patent
Song

(10) Patent No.: US 11,585,505 B2
(45) Date of Patent: Feb. 21, 2023

(54) LAMP FOR VEHICLE, METHOD OF MANUFACTURING THE SAME, AND VEHICLE INCLUDING THE SAME

(71) Applicant: HYUNDAI MOBIS CO., LTD., Seoul (KR)

(72) Inventor: Ki Ryong Song, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/342,846

(22) Filed: Jun. 9, 2021

(65) Prior Publication Data

US 2022/0186900 A1 Jun. 16, 2022

(30) Foreign Application Priority Data

Dec. 14, 2020 (KR) ..... 10-2020-0174739

(51) Int. Cl.
*F21S 41/20* (2018.01)
*F21S 41/24* (2018.01)
*F21S 41/29* (2018.01)

(52) U.S. Cl.
CPC ..... *F21S 41/24* (2018.01); *F21S 41/29* (2018.01)

(58) Field of Classification Search
CPC ..... F21S 41/24; F21S 41/29; F21S 43/237; F21S 43/245; F21S 43/251; F21S 43/37; F21S 43/14; B60Q 3/62; G02B 6/04; G02B 27/0994; G02B 6/4249; G02B 6/001; G02B 6/0008; G02B 6/2552; G02B 6/08; G02B 6/3628; G02B 6/3636; G02B 6/4236; F21V 2200/10; F21V 2200/15; G02F 1/133524; B60R 1/1207; B60R 1/06; F21Y 2115/10
See application file for complete search history.

(56) References Cited

U.S. PATENT DOCUMENTS 4,183,576 A * 1/1980 Frymire ..... B60J 7/1642 296/218
4,234,907 A * 11/1980 Daniel ..... D02G 3/441 362/556
5,021,928 A * 6/1991 Daniel ..... F21S 8/00 362/556

(Continued)

FOREIGN PATENT DOCUMENTS

CN 110050156 A * 7/2019 ..... F21S 43/237
JP 2011-296436 10/2001

(Continued)

OTHER PUBLICATIONS

Korean Office Action dated Aug. 31, 2022 issued in Korean Application No. 10-2020-0174739.

(Continued)

*Primary Examiner* — Omar Rojas Cadima
(74) *Attorney, Agent, or Firm* — DLA Piper LLP (US)

(57) ABSTRACT

A lamp for a vehicle, the lamp including: a light source; a board part on which the light source is mounted; an optical fiber configured to provide a path through which light emitted from the light source propagates; and a film part to which the optical fiber is joined, in which the film part includes an upper film provided at an upper side of the optical fiber; and a lower film provided at a lower side of the optical fiber, and in which the optical fiber is joined to each of the upper film and the lower film.

11 Claims, 5 Drawing Sheets

(56) References Cited

U.S. PATENT DOCUMENTS

| | | | | |
|---|---|---|---|---|
| 2011/0176326 | A1* | 7/2011 | Stephan | A61N 5/0616 362/555 |
| 2018/0142860 | A1* | 5/2018 | Potter | F21S 43/243 |
| 2018/0297515 | A1* | 10/2018 | Laluet | B32B 17/10788 |
| 2019/0009709 | A1 | 1/2019 | Escoffier | |

FOREIGN PATENT DOCUMENTS

| | | | | |
|---|---|---|---|---|
| KR | 2020-0113443 | | 10/2020 | |
| KR | 2020-0114588 | | 10/2020 | |
| WO | WO-2007003857 | A2 * | 1/2007 | G02B 6/4204 |

OTHER PUBLICATIONS

Song et al. "A Study of Optical Fiber Applied Rearlamp",http://www.dbpia.co.kr/journal/articleDetail?nodeId=NODE10519367, Jul. 15, 2021, 2 pages.

English Language Abstract of JP 2011-296436 published Oct. 26, 2001.

English Language Abstract of KR 2020-0113443 published Oct. 7, 2020.

English Language Abstract of KR 2020-0114588 published Oct. 7, 2020.

* cited by examiner

LAMP FOR VEHICLE, METHOD OF MANUFACTURING THE SAME, AND VEHICLE INCLUDING THE SAME

CROSS-REFERENCE TO RELATED APPLICATION

This application claims priority to and the benefit of Korean Patent Application No. 10-2020-0174739 filed in the Korean Intellectual Property Office on Dec. 14, 2020, the entire contents of which are incorporated herein by reference.

TECHNICAL FIELD

The present disclosure relates to a lamp for a vehicle, which has a novel structure in comparison with the related art, a method of manufacturing the lamp, and a vehicle including the lamp.

BACKGROUND ART

With an increase in customers' interest in external appearances of lamps mounted in vehicles as well as performance of the lamps, studies are being actively conducted on a lamp for a vehicle that has not only improved performance, but also improved aesthetic properties.

However, because a configuration and a structure of the lamp for a vehicle in the related art are restricted by many factors, there is a limitation in developing the lamp for a vehicle that has significantly improved performance and aesthetic properties. Accordingly, there is a need for a lamp for a vehicle that has a novel structure in comparison with the related art.

SUMMARY

The present disclosure has been made in an effort to provide a new type of lamp for a vehicle which is manufactured to have a novel structure in comparison with the related art and thus have improved performance and aesthetic properties.

In a first aspect, the present disclosure provides a lamp for a vehicle, the lamp including: a light source; a board part on which the light source is mounted; an optical fiber configured to provide a path through which light emitted from the light source propagates; and a film part to which the optical fiber is joined, in which the film part includes: an upper film provided at an upper side of the optical fiber; and a lower film provided at a lower side of the optical fiber, and in which the optical fiber is joined to each of the upper film and the lower film.

The lamp may further include a bezel part to which the film part is fixed.

The lamp may further include a penetration member configured to penetrate the film part, in which the penetration member penetrates the film part and is coupled to the bezel part.

The bezel part may have a recessed portion having a recessed shape, and the film part may be inserted into the recessed portion.

The bezel part may include: an upper bezel provided at an upper side of the film part; and a lower bezel provided at a lower side of the film part, the recessed portions may be provided in the upper bezel and the lower bezel, respectively, and the film part may be inserted into the recessed portion provided in the upper bezel and the recessed portion provided in the lower bezel.

The lamp may further include: a lens part provided between the light source and the optical fiber and configured such that the light emitted from the light source enters the lens part; and a first bracket provided between the lens part and the optical fiber, in which the first bracket is provided to be in close contact with the board part.

The lens part may be provided in an internal space provided between the board part and the first bracket, and the first bracket may be provided to press the lens part toward the board part.

The lamp may further include: a second bracket provided between the first bracket and the optical fiber and configured such that the optical fiber is inserted and coupled into the second bracket, in which the second bracket is inserted and coupled into the first bracket.

The upper film and the lower film may be joined to each other, and the upper film and the lower film may be made of different materials.

The lamp may further include a plate part provided at a rear side of the board part and provided to be in close contact with the board part.

The optical fiber may be provided in plural, and at least some of the plurality of optical fibers may intersect one another.

The film part may include: a first film part joined to one end of the optical fiber, which faces the light source between the two ends of the optical fiber; and a second film part joined to the other end of the optical fiber opposite to one end of the optical fiber.

In a second aspect, the present disclosure provides a vehicle including: a lamp for a vehicle, in which the lamp includes: a light source; a board part on which the light source is mounted; an optical fiber configured to provide a path through which light emitted from the light source propagates; and a film part to which the optical fiber is joined, in which the film part includes: an upper film provided at an upper side of the optical fiber; and a lower film provided at a lower side of the optical fiber, and in which the optical fiber is joined to each of the upper film and the lower film.

In a third aspect, the present disclosure provides a method of manufacturing a lamp for a vehicle, the method including: a first step of preparing a film part, a bezel part, and a plurality of optical fibers; a second step of disposing the plurality of optical fibers on one surface of the film part; a third step of joining the plurality of optical fibers to one surface of the film part; and a fourth step of coupling the film part to one surface of the bezel part.

The film part may include an upper film and a lower film, the second step may include disposing the upper film at an upper side of the plurality of optical fibers and disposing the lower film at a lower side of the plurality of optical fibers, and the third step may include joining the upper film and the lower film.

The third step may include joining the upper film and the lower film by high-frequency welding.

In the third step, the high-frequency welding may be performed at 200° C. or below.

Each of the upper film and the lower film may be made of any one material selected from a group consisting of TPU (thermoplastic polyurethane), PETG (polyethylene terephthalate glycol), and PVC (polyvinyl chloride).

The second step may include temporarily joining the plurality of optical fibers to an upper surface of the lower film and then disposing the upper film on an upper side of the plurality of optical fibers.

According to the present disclosure, it is possible to provide a new type of lamp for a vehicle which is manufactured to have a novel structure in comparison with the related art and thus have improved performance and aesthetic properties.

DETAILED DESCRIPTION

Hereinafter, a lamp for a vehicle, a vehicle including the lamp, and a method of manufacturing the lamp according to the present disclosure will be described with reference to the drawings.

Lamp for Vehicle

Figure 1:
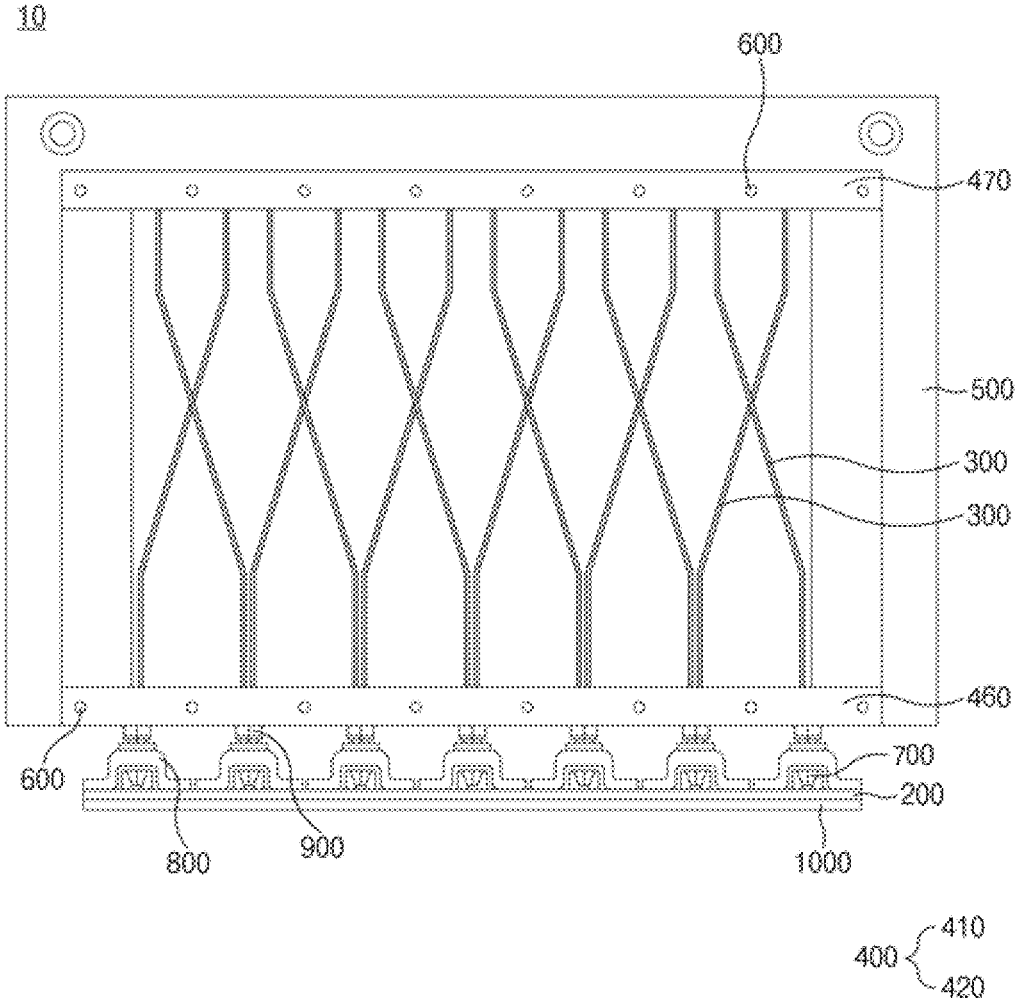
FIG. 1 is a top plan view illustrating a structure of a lamp for a vehicle according to the present disclosure.
Figure 2:
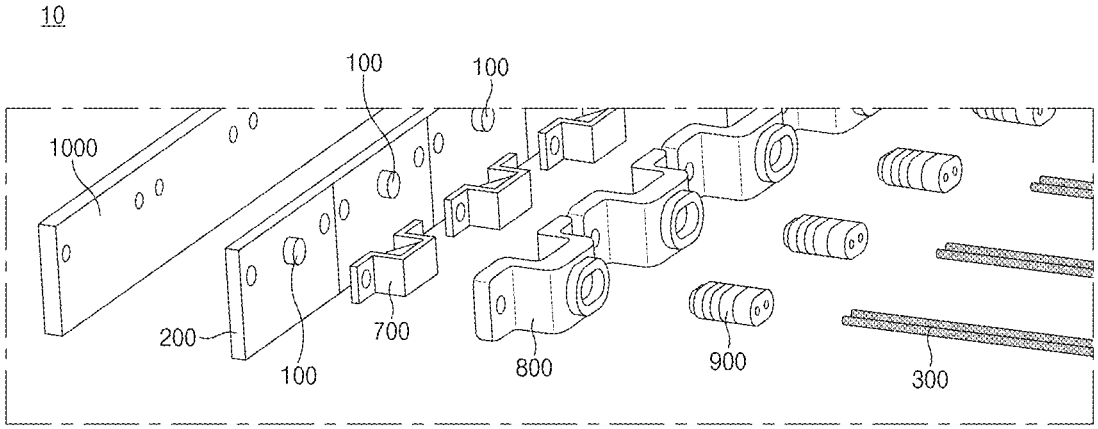
FIG. 2 is an exploded perspective view illustrating main components of the lamp for a vehicle according to the present disclosure.
Figure 3:
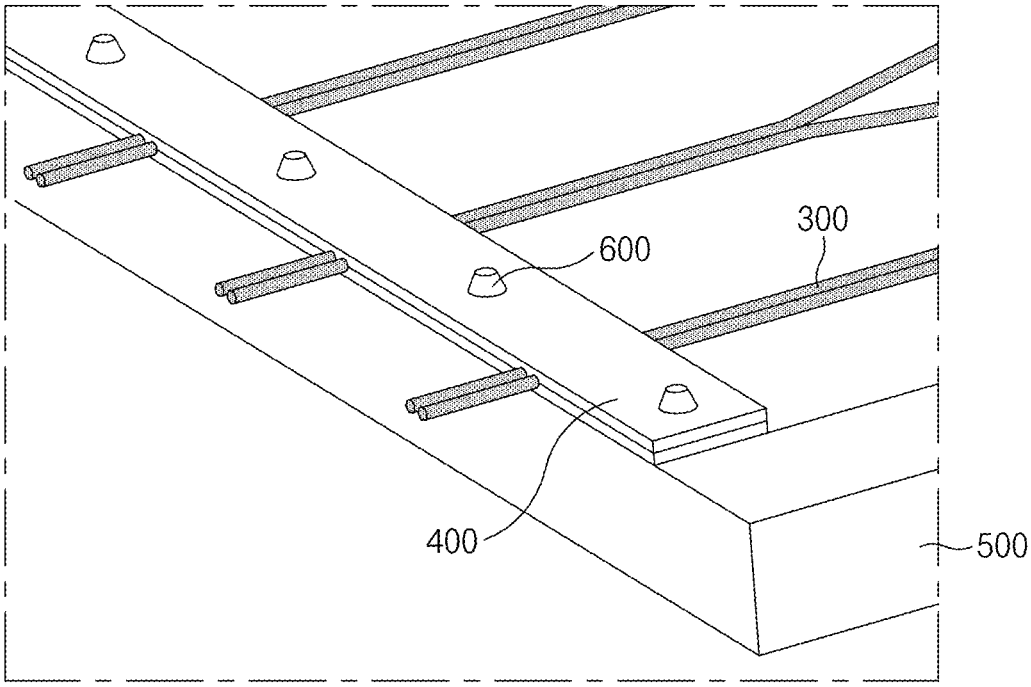
FIG. 3 is a perspective view illustrating a state of the lamp for a vehicle according to the present disclosure in which optical fibers, a film part, and a bezel part are coupled.
Figure 4:
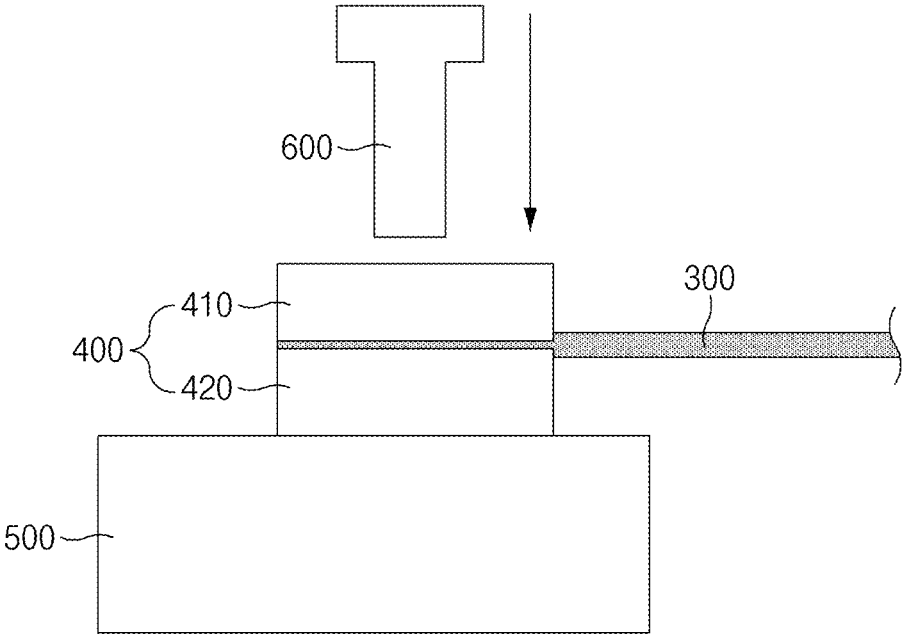
FIG. 4 is a cross-sectional view illustrating an example of a structure of the lamp for a vehicle according to the present disclosure in which the optical fibers, the film part, and the bezel part are coupled.
Figure 5:
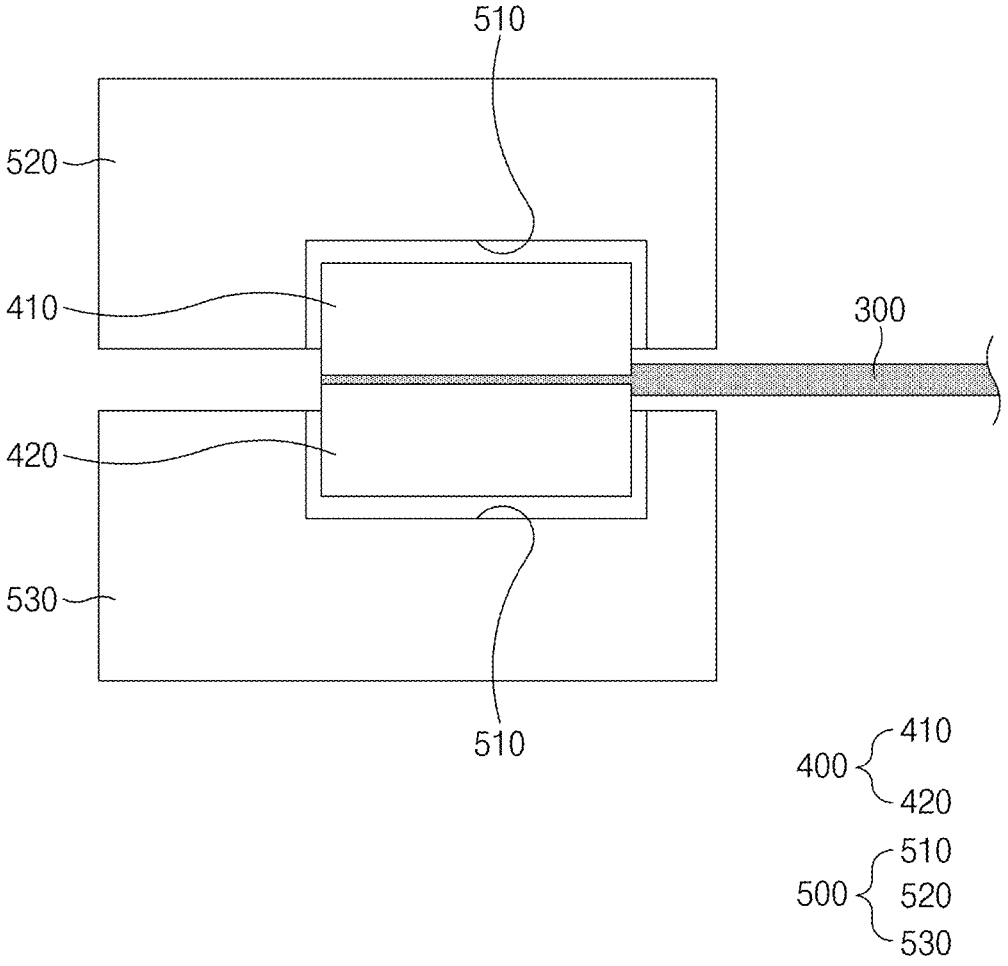
FIG. 5 is a cross-sectional view illustrating another example of a structure of the lamp for a vehicle according to the present disclosure in which the optical fibers, the film part, and the bezel part are coupled.
Figure 6:
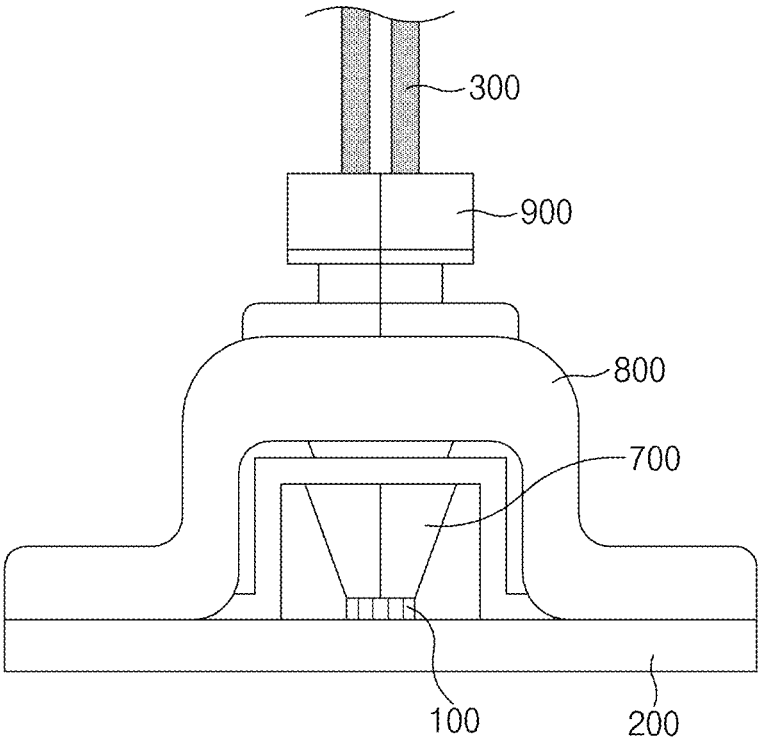
FIG. 6 is an enlarged top plan view illustrating a state of the lamp for a vehicle according to the present disclosure in which a board part, a lens part, a first bracket, and a second bracket are coupled.

FIG. 1 is a top plan view illustrating a structure of a lamp for a vehicle according to the present disclosure, and FIG. 2 is an exploded perspective view illustrating main components of the lamp for a vehicle according to the present disclosure. FIG. 3 is a perspective view illustrating a state of the lamp for a vehicle according to the present disclosure in which optical fibers, a film part, and a bezel part are coupled, and FIG. 4 is a cross-sectional view illustrating an example of a structure of the lamp for a vehicle according to the present disclosure in which the optical fibers, the film part, and the bezel part are coupled. FIG. 5 is a cross-sectional view illustrating another example of a structure of the lamp for a vehicle according to the present disclosure in which the optical fibers, the film part, and the bezel part are coupled, and FIG. 6 is an enlarged top plan view illustrating a state of the lamp for a vehicle according to the present disclosure in which a board part, a lens part, a first bracket, and a second bracket are coupled.

As illustrated in FIGS. 1 and 2, a lamp 10 for a vehicle (hereinafter, referred to as a 'lamp') according to the present disclosure may include light sources 100 and a board part 200 on which the light sources are mounted. For example, the light source 100 may be an LED or a laser, and the board part 200 may be a printed circuit board (PCB). However, the type of the light source 100 and the type of the board part 200 are not limited thereto. Meanwhile, the light source 100 may be provided in plural.

In addition, the lamp 10 may further include optical fibers 300 that provide paths through which light emitted from the light source 100 propagates. According to the present disclosure, the optical fiber 300 may be configured such that the light emitted from the light source 100 enters the optical fiber 300, propagates forward while being totally reflected in the optical fiber 300, and then exits the optical fiber 300. For example, a diameter of the optical fiber 300 may be 0.25 mm to 4.0 mm, but the diameter of the optical fiber 300 is not limited thereto.

The optical fiber 300 may be provided in plural in the lamp 10. FIG. 1 illustrates an example in which fourteen optical fibers 300 are provided in the lamp 10. In this case, according to the present disclosure, at least some of the plurality of optical fibers 300 may be provided to intersect one another. FIG. 1 illustrates that the adjacent optical fibers, among the plurality of optical fibers 300, intersect each other. In contrast, the plurality of optical fibers 300 may be provided side by side without intersecting one another.

In addition, as illustrated in FIG. 1, the lamp 10 may further include a film part 400 to which the optical fibers 300 are joined. The film part 400 may be configured to fix the optical fibers 300.

That is, because the optical fiber 300 is elongated while having a small thickness, the optical fiber 300 has low durability, and it is difficult to maintain an aligned state of the optical fibers 300 during a manufacturing process. Therefore, according to the present disclosure, since the optical fibers 300 are joined to the film part 400, the optical fibers 300 may be protected from the outside. Further, as described below, the aligned state of the plurality of optical fibers 300 may be maintained during the process of manufacturing the lamp 10, such that productivity of the lamp 10 may also be improved.

Meanwhile, referring to FIGS. 3 to 5, the film part 400 may include an upper film 410 provided at an upper side of the optical fibers 300, and a lower film 420 provided at a lower side of the optical fibers 300. Therefore, at least a part of the optical fiber 300 may be provided between the upper film 410 and the lower film 420.

Furthermore, the optical fibers 300 may be joined to the upper film 410 and the lower film 420, and the upper film 410 and the lower film 420 may be joined to each other. Therefore, the optical fibers 300, the upper film 410, and the lower film 420 may be fixed by being joined to one another.

Referring to FIGS. 1 and 3, the lamp 10 may further include a bezel part 500 to which the film part 400 is fixed. The bezel part 500 may be configured to support the film part 400 to protect the film part 400 and the optical fibers 300 from the outside and also configured to ensure overall rigidity of the lamp 10.

Meanwhile, referring to FIGS. 3 and 4, the lamp 10 according to one example of the present disclosure may further include penetration members 600 that penetrate the film part 400. In addition, the penetration members 600 may be coupled to the bezel part 500 after penetrating the film part 400. Therefore, according to one example of the present disclosure, the film part 400 may be fixed to the bezel part 500 by the penetration members 600. The penetration member 600 may have structures having various shapes, such as a hook structure or a screw structure.

In contrast, referring to FIG. 5, in the lamp 10 according to another example of the present disclosure, the bezel part 500 may have recessed portions 510 each having a recessed shape, and the film part 400 may be inserted into the recessed portions 510.

In more detail, the bezel part 500 may include an upper bezel 520 provided at an upper side of the film part 400, and a lower bezel 530 provided at a lower side of the film part 400. In addition, the recessed portions 510 may be provided in the upper bezel 520 and the lower bezel 530, respectively, in a region in which the upper bezel 520 and the lower bezel 530 face each other. The film part 400 may be inserted into the recessed portion provided in the upper bezel 520 and the recessed portion provided in the lower bezel 530. Therefore, according to another example of the present disclosure, the film part 400 may be fixed to the bezel part 500 by the recessed portions 510. In order to further increase a fixing force, the upper bezel 520 and the lower bezel 530 may be joined to each other.

Referring to FIGS. 1, 2, and 6, the lamp 10 according to the present disclosure may further include: lens parts 700 each provided between the light source 100 and the optical fiber 300 and configured such that the light emitted from the light source 100 enters the lens part 700; and first brackets 800 each provided between the lens part 700 and the optical fiber 300. In this case, as illustrated in FIG. 6, the first bracket 800 may be provided to be in close contact with the board part 200. The light, which is emitted from the light source 100 and then enters the lens part 700, may exit the lens part 700 and then enter the optical fiber 300. In addition, the first bracket 800 may be configured to fix the lens part 700 and also configured to fix a second bracket 900, as described below.

In more detail, as illustrated in FIG. 6, an internal space may be provided between the board part 200 and the first bracket 800, and the lens part 700 may be provided in the internal space. In addition, more particularly, the first bracket 800 may be provided to press the lens part 700 toward the board part 200. Therefore, according to the present disclosure, since the lens part 700 provided in the lamp 10 is fixed to the board part 200 and the first bracket 800, the aligned state of the light source 100 and the lens part 700 may be maintained.

Referring to FIGS. 1, 2, and 6, the lamp 10 according to the present disclosure may further include the second brackets 900 each provided between the first bracket 800 and the optical fiber 300 and configured such that the optical fiber 300 is inserted into the second bracket 900. In this case, the second bracket 900 may be inserted and coupled into the first bracket 800. Therefore, according to the present disclosure, the aligned state of the light sources 100, the lens parts 700, the first brackets 800, the second brackets 900, and the optical fibers 300 may be maintained.

Meanwhile, the upper film 410 and the lower film 420 may be joined to each other as described above. In this case, the upper film 410 and the lower film 420 may be made of different materials. In addition, each of the upper film 410 and the lower film 420 may be made of any one material selected from a group consisting of TPU (thermoplastic polyurethane), PETG (polyethylene terephthalate glycol), and PVC (polyvinyl chloride). For example, the upper film 410 may be made of PETG, and the lower film 420 may be made of TPU.

In addition, the lamp 10 according to the present disclosure may further include a plate part 1000 provided at a lower side of the board part 200 and provided to be in close contact with the board part 200. The plate part 1000 may be configured to protect the board part 200 and fix a position of the board part 200.

Meanwhile, in the lamp 10 according to the present disclosure, the film part 400 may be provided in plural. For example, as illustrated in FIG. 1, the film part 400 may include a first film part 460 joined to one end of the optical fiber 300, which faces the light source 100 between the two ends of the optical fiber 300, and a second film part 470 joined to the other end of the optical fiber 300 opposite to one end of the optical fiber 300. The above-mentioned description for the film part 400 may be equally applied to the first film part 460 and the second film part 470. Therefore, the description for the first film part 460 and the second film part 470 may be replaced with the above-mentioned description for the film part 400.

Vehicle

A vehicle according to the present disclosure may include the lamp 10 for a vehicle (hereinafter, referred to as the 'lamp'). In this case, the lamp 10 may include the light sources 100, the board part 200 on which the light sources 100 are mounted, the optical fibers 300 configured to provide the paths through which the light emitted from the light sources 100 propagates, and the film part 400 to which the optical fibers 300 are joined.

In addition, the film part 400 may include the upper film 410 provided at the upper side of the optical fibers 300, and the lower film 420 provided at the lower side of the optical fibers 300, and the optical fibers 300 may be joined to the upper film 410 and the lower film 420.

The detailed description for the lamp provided in the vehicle according to the present disclosure may be replaced with the above-mentioned description for the lamp for a vehicle according to the present disclosure.

Method of Manufacturing Lamp for Vehicle

Referring to FIGS. 1 to 6, a method of manufacturing the lamp for a vehicle according to the present disclosure may include a first step of preparing the film part 400, the bezel part 500, and the plurality of optical fibers 300, a second step of disposing the plurality of optical fibers 300 on one surface of the film part 400, a third step of joining the plurality of optical fibers 300 to one surface of the film part 400, and a fourth step of coupling the film part 400 to one surface of the bezel part 500.

In more detail, according to the present disclosure, the film part 400 may include the upper film 410 and the lower film 420. In the second step, the upper film 410 may be disposed at the upper side of the plurality of optical fibers 300, and the lower film 420 may be disposed at the lower side of the plurality of optical fibers 300. In addition, in the third step, the upper film 410 and the lower film 420 may be joined to each other.

Meanwhile, according to the present disclosure, in the third step, the upper film 410 and the lower film 420 may be joined to each other by high-frequency welding. In particular, the high-frequency welding may be performed at 200° C. or below. Therefore, according to the present disclosure, it is possible to prevent the upper film 410, the lower film 420, and the optical fibers 300 from being damaged during the process of joining the upper film 410 and the lower film 420.

Meanwhile, the second step may include temporarily joining the plurality of optical fibers 300 to an upper surface of the lower film 420 and then disposing the upper film 410 at an upper side of the plurality of optical fibers 300. In this case, since the third step may be performed after temporarily joining the plurality of optical fibers 300 to the upper surface of the lower film 420, it is possible to prevent the plurality of optical fibers 300 from being misaligned in the third step.

In addition, each of the upper film 410 and the lower film 420 may be made of any one material selected from a group consisting of TPU (thermoplastic polyurethane), PETG (polyethylene terephthalate glycol), and PVC (polyvinyl chloride).

The present disclosure has been described with reference to the limited embodiments and the drawings, but the present disclosure is not limited thereto. The present disclosure may be carried out in various forms by those skilled in the art to which the present disclosure pertains within the technical spirit of the present disclosure and within the scope equivalent to the appended claims.

DESCRIPTION OF REFERENCE NUMERALS

10: Lamp
100: Light source
200: Board part
300: Optical fiber
400: Film part
410: Upper film
420: Lower film
460: First film part
470: Second film part
500: Bezel part
510: Recessed portion
520: Upper bezel
530: Lower bezel
600: Penetration member
700: Lens part
800: First bracket
900: Second bracket
1000: Plate part

What is claimed is:

1. A lamp for a vehicle, the lamp comprising:
a light source;
a board part on which the light source is mounted;
an optical fiber configured to provide a path through which light emitted from the light source propagates;
a film part to which the optical fiber is joined; and
a penetration member configured to penetrate the film part,
wherein the film part comprises an upper film provided at an upper side of the optical fiber; and
a lower film provided at a lower side of the optical fiber,
wherein the optical fiber is in direct contract with each of the upper film and the lower film such that a portion of the optical fiber in direct contact with each of the upper film and the lower film is sandwiched in between the upper film and the lower film,
wherein the upper film and the lower film are made of different materials, and
wherein the penetration member penetrates the upper film, the lower film and also penetrates a bezel part.

2. The lamp of claim 1, further comprising:
the bezel part to which the film part is fixed.

3. The lamp of claim 2, wherein the bezel part has a recessed portion having a recessed shape, and the film part is inserted into the recessed portion.

4. The lamp of claim 3, wherein the bezel part comprises:
an upper bezel provided at an upper side of the film part; and
a lower bezel provided at a lower side of the film part,
wherein recessed portions are provided in the upper bezel and the lower bezel, and
the film part is inserted into the recessed portion provided in the upper bezel and the recessed portion provided in the lower bezel.

5. The lamp of claim 1, further comprising:
a lens part provided between the light source and the optical fiber and configured such that the light emitted from the light source enters the lens part; and
a first bracket provided between the lens part and the optical fiber and in close contact with the board part.

6. The lamp of claim 5, wherein the lens part is provided in an internal space provided between the board part and the first bracket, and the first bracket is provided to press the lens part toward the board part.

7. The lamp of claim 5, further comprising:
a second bracket provided between the first bracket and the optical fiber and configured such that the optical fiber is inserted and coupled into the second bracket,
wherein the second bracket is inserted and coupled into the first bracket.

8. The lamp of claim 1, further comprising:
a plate part provided at a lower side of the board part and in close contact with the board part.

9. The lamp of claim 1, further comprising a plurality of optical fibers, wherein at least some of the plurality of optical fibers intersect one another.

10. The lamp of claim 1, wherein the film part comprises:
a first film part in direct contact with one end of the optical fiber, which faces the light source between two ends of the optical fiber; and
a second film part in direct contact with another end of the optical fiber opposite to said one end of the optical fiber.

11. A vehicle comprising:
a lamp for the vehicle, wherein the lamp comprises:
a light source;
a board part on which the light source is mounted;
an optical fiber configured to provide a path through which light emitted from the light source propagates;
a film part to which the optical fiber is joined;
a penetration member configured to penetrate the film part,
wherein the film part comprises:
an upper film provided at an upper side of the optical fiber; and
a lower film provided at a lower side of the optical fiber,
wherein the optical fiber is in direct contact with each of the upper film and the lower film such that a portion of the optical fiber in direct contact with each of the upper film and the lower film is sandwiched in between the upper film and the lower film,
wherein the upper film and the lower film are made of different materials,
wherein the penetration member penetrates the upper film, the lower film and also penetrates a bezel part.

* * * * *